United States Patent [19]

Shimomura et al.

[11] Patent Number: 4,913,121

[45] Date of Patent: Apr. 3, 1990

[54] FUEL CONTROLLER

[75] Inventors: Setsuhiro Shimomura; Yukinobu Nishimura, both of Himeji, Japan

[73] Assignee: Mitsubishi Denki Kabushiki Kaisha, Tokyo, Japan

[21] Appl. No.: 322,949

[22] Filed: Mar. 14, 1989

[30] Foreign Application Priority Data

Mar. 23, 1988 [JP] Japan ..... 63-71459

[51] Int. Cl.[4] ..... F02D 41/14; F02M 25/08

[52] U.S. Cl. ..... 123/489; 123/520

[58] Field of Search ..... 123/440, 489, 520

[56] References Cited

U.S. PATENT DOCUMENTS

| | | | |
|---|---|---|---|
| 4,130,095 | 12/1978 | Bowler et al. | 123/440 |
| 4,467,769 | 8/1984 | Matsumura | 123/489 |
| 4,530,333 | 7/1985 | Nishimura | 123/489 |
| 4,817,573 | 4/1989 | Yamada et al. | 123/440 X |

FOREIGN PATENT DOCUMENTS 150057 9/1983 Japan .

*Primary Examiner*—Tony M. Argenbright

*Attorney, Agent, or Firm*—Sughrue, Mion, Zinn, Macpeak & Seas

[57] ABSTRACT

The invention relates to a novel fuel controller of an internal combustion engine. In particular, it relates to a novel fuel controller which securely corrects characteristic variation with time of air-flow sensor used for controlling flow of fuel. The fuel controller embodied by the invention incorporates a memory which stores the negative feedback correction value of air-fuel ratio or the value related to it at the flow-volume point representing variation of characteristic of air-flow sensor or at an adjacent point of it so that the basic volume needed for controlling flow of fuel can be corrected by applying the content of memory. As a result, even if characteristic of the air-flow sensor varies, the system can achieve satisfactory control condition. The fuel controller inhibits renewal of the study on the negative feedback correction value for the predetermined period in accordance with the opening/closing condition of the purge-control valve. As a result, the fuel controller can securely and constantly perform satisfactory fuel-flow control operation without being influenced by erroneous air-fuel ratio caused by presence of purged gas.

7 Claims, 4 Drawing Sheets

ε

QL
QOL
Q
0
CFB

NEGATIVE FEEDBACK
NO NEGATIVE FEEDBACK

FUEL CONTROLLER

BACKGROUND OF THE INVENTION

1. Field of the Invention

The present invention relates to a fuel controller of an internal combustion engine, more particularly, to a fuel controller which corrects time-aged characteristic variation of air-flow sensor like hot-wire air-flow sensor used for controlling flow of fuel.

2. Description of the Prior Art

Physical characteristic of hot-wire air-flow sensor is subject to variation by adverse influence of materials adhered to the surface of hot-wire and as a result, error occurs in the volume of fuel which is fed to the internal combustion engine. This results in the occurrence of more pollutant in exhaust gas and degraded driving performance. Characteristic of vane-type air-flow sensor is also variable by materials deposited on sliding members, and thus, above problems also occur. In addition, variation of physical characteristic variation caused by deposited material is largely dependent on the volume of fuel passing through the air-flow sensor. Conventionally, negative feedback control by applying air-fuel (A/F) ratio sensor is effective for correcting characteristic of those sensors mentioned above. To correct physical characteristic of sensors in specific regions where the negative feedback control is inapplicable, Japanese Patent Application Laid-Open No. 58-150057 (1983) discloses a system for implementing study correction. This is substantially a device for correcting air-fuel ratio by negatively feeding back signals from A/F ratio sensor installed to the exhaust tube of the engine, where memory of the device memorizes the negative feedback volume so that the device can correct the basic value of fuel control operation according to the content of memory even in such a region where the negative feedback control is inapplicable.

When implementing the study correction by estimating physical characteristic variation of the air-flow sensor from the correction volume in the region in which characteristic variation of air-flow sensor can be corrected by negative feedback means in a specific region under presence of much volume of flowing fuel where specific air-fuel ratio thicker than the theoretical A/F ratio is required and the negative feedback control cannot be executed, if there are transitory error air-fuel ratio which peculiarly affects the above specific region when executing negative feedback correction, then the studied correction value to be estimated becomes incorrect and aggravates erroneous air-fuel ratio in the region where large volume of fuel flows. As a transitory influential error mentioned above, there is such an error of the air-fuel ratio which normally occurs when purging evaporated fuel caught by canister through the air intake passage of the engine. Purging of evaporated fuel generates substantial influence when the engine is driven under low load, i.e., when less volume of air is sucked. Influence of purge remains substantially low when much volume of air flows. Consequently, unless the influence of purge is eliminated, estimated study correction cannot be achieved.

SUMMARY OF THE INVENTION

The invention has been achieved to fully solve those problems mentioned above. The fuel controller related to the invention characteristically comprises memory which stores the correction volume of the A/F ratio negative feedback or the volume related to it when the output level of the air-flow sensor approximates the predetermined representative point, and means for correcting the basic fuel-control volume in accordance with the content stored in memory in order that fuel control means executing negative feedback correction of the basic fuel-control volume can correct the basic volume by applying the studied correction value in memory.

The primary object of the invention is to provide a novel fuel controller capable of correcting error of air-fuel ratio in such regions where large volume of fuel and air flow and negative feedback correction of air-fuel ratio cannot be executed.

The second object of the invention is to provide a novel fuel controller capable of securely maintaining satisfactory fuel control condition even when characteristic of the air-flow sensor varies.

The fuel controller related to the invention comprises means for inhibiting fuel control means from writing data into memory for a specific period determined in accordance with the opening/closing condition of the purged gas control valve.

The third object of the invention is to provide a novel fuel controller capable of minimizing influence of purged gas on the negative feedback correction value to be studied.

The fourth object of the invention is to provide a novel fuel controller capable of executing satisfactory fuel control operation by preventing occurrence of adverse effect of the air-fuel ratio error caused by purged gas.

The above and further objects and features of the invention will more fully be apparent from the following detailed description with accompanying drawings.

DESCRIPTION OF THE PREFERRED EMBODIMENTS

Figure 1:
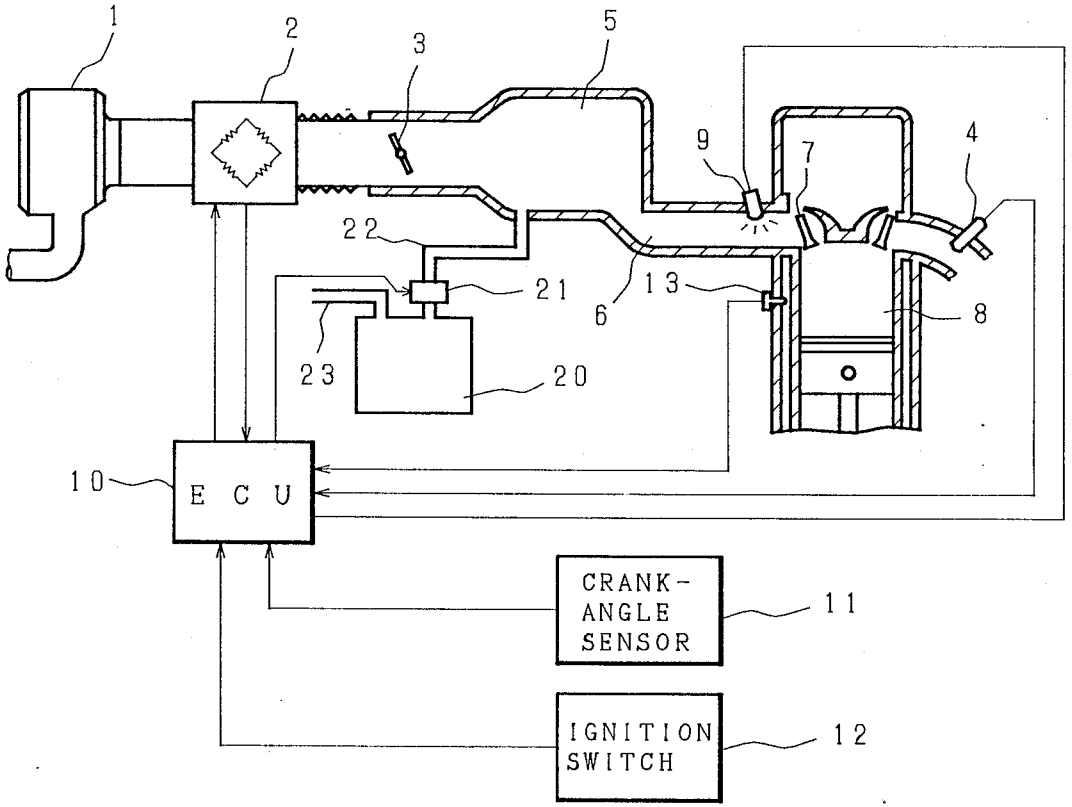
FIG. 1 is the simplified block diagram of a preferred embodiment of the fuel controller related to the invention.

Referring now to the accompanying drawings, a preferred embodiment of the fuel controller related to the invention is described below. FIG. 1 is the simplified block diagram of a preferred embodiment of the fuel controller related to the invention, which represents the constitution of the fuel controller incorporating hot-wire air-flow sensor (hereinafter called AFS) which detects the volume of air supplied to the engine. The reference number 1 designates air-cleaner through which atmospheric air is sucked, 2 designates AFS, and 3 designates throttle valve which controls volume of air to be supplied to the engine. Air-intake manifold 6 is connected to surge tank 5 and cylinder 8. Cylinder 8 is provided with air-intake valve 7 which is driven by a cam not shown in FIG. 1. To simplify the drawing, only one unit of cylinder 8 is shown in FIG. 1. However, actually, there are a plurality of cylinders 8.

Each cylinder 8 is provided with a fuel control valve (hereinafter called injector) 9. Electronic control unit (hereinafter called ECU) 10 controls volume of fuel jetted out of the injector 9 so that the jetted volume can match the predetermined air-fuel ratio against the volume of air supplied to each cylinder 8. The reference numeral 4 designates $O_2$ sensor which is used for negatively feeding back the air-fuel ratio.

The ECU 10 determines the volume of fuel to be jetted out of the injector in accordance with signals from AFS 2, crank-angle sensor 11, ignition switch 12, cooled-water temperature sensor 13 of the engine, and $O_2$ sensor 4, and at the same time, synchronous with signal from the crank-angle sensor 11, the ECU 10 feeds fuel injection pulse having a specific width corresponding to the jetted fuel volume to the injector 9. Canister 20 catches evaporated fuel from the fuel tank (not shown) through passage 23, and then purges it to the surge tank 5 through the electric control valve 21 like solenoid valve which is controlled by the ECU 10 and also through passage 22.

Figure 2:
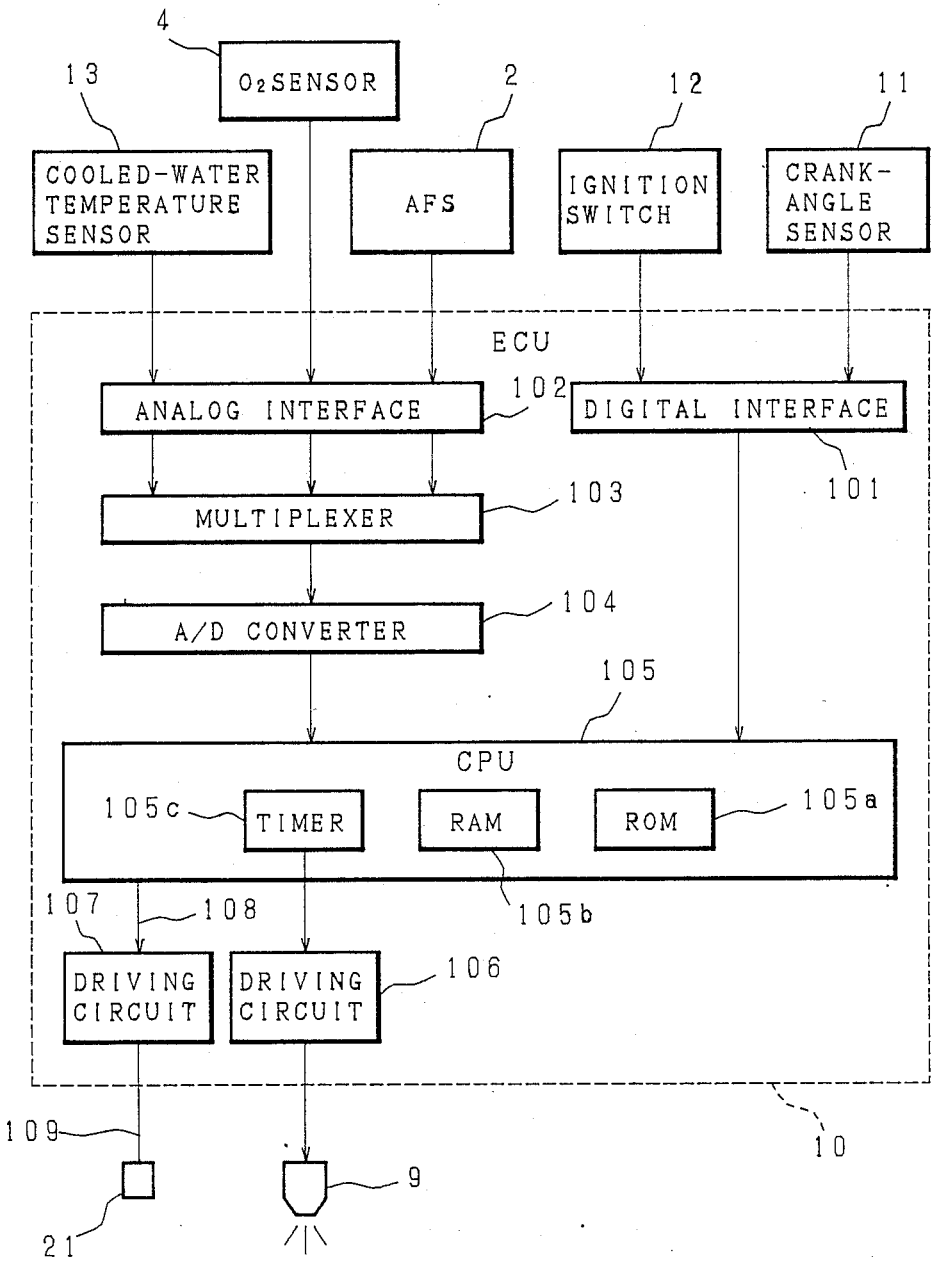
FIG. 2 is the simplified block diagram of the electronic control unit (ECU) shown in FIG. 1.

FIG. 2 designates the internal constitution of the ECU 10 which incorporates the digital-input interface circuit 101 composed of the crank-angle sensor 11 and the ignition switch 12 and the analog-input interface circuit 102 composed of AFS 2, cooled-water temperature sensor 13, and $O_2$ sensor 4. The reference numeral 103 designates multiplexer. Analog-digital (A/D) converter 104 sequentially converts input analog signals from AFS 2, cooled-water temperature sensor 13, and $O_2$ sensor 4, into digital values. The central processing unit (CPU) 105 incorporates ROM 105*a* and RAM 105*b*. Based on signals from the digital-input interface circuit 101 and the A/D converter 104 and in accordance with programs stored in ROM 105*a*, the CPU 105 computes the width of pulse which drives the injector 9, and then allows timer 105*c* to output pulses each having specific time width, where the timer 105*c* is triggered synchronous with signals from the crank-angle sensor 11. When the CPU 105 computes the width of pulse, the CPU 105 first computes the basic volume of the jetted fuel (Q/N) corresponding to the volume of air intake per rotation of the engine by applying the number N of the rotation of the crank sought by measuring the period of signals from the crank-angle sensor 11 and the flowing volume Q of air intake calculated from signals outputted from AFS 2, and then determines the width of pulse by correcting the basic volume of the jetted fuel (Q/N) by applying correction volume calculated in accordance with signals output from the cooled-water temperature sensor 13 and $O_2$ sensor 4. These pulses are amplified by the driving circuit 106 which drives the injector 9. The above constitution related to the control of fuel flow is conventionally known well, and thus, detailed description is deleted.

The CPU 105 driving the driving circuit 107 by applying output 108 which corresponds to the predetermined operating condition of the engine by means of those inputs which designate parameter of the engine, and the electric control valve 21 is driven by the output 109.

Figure 3:
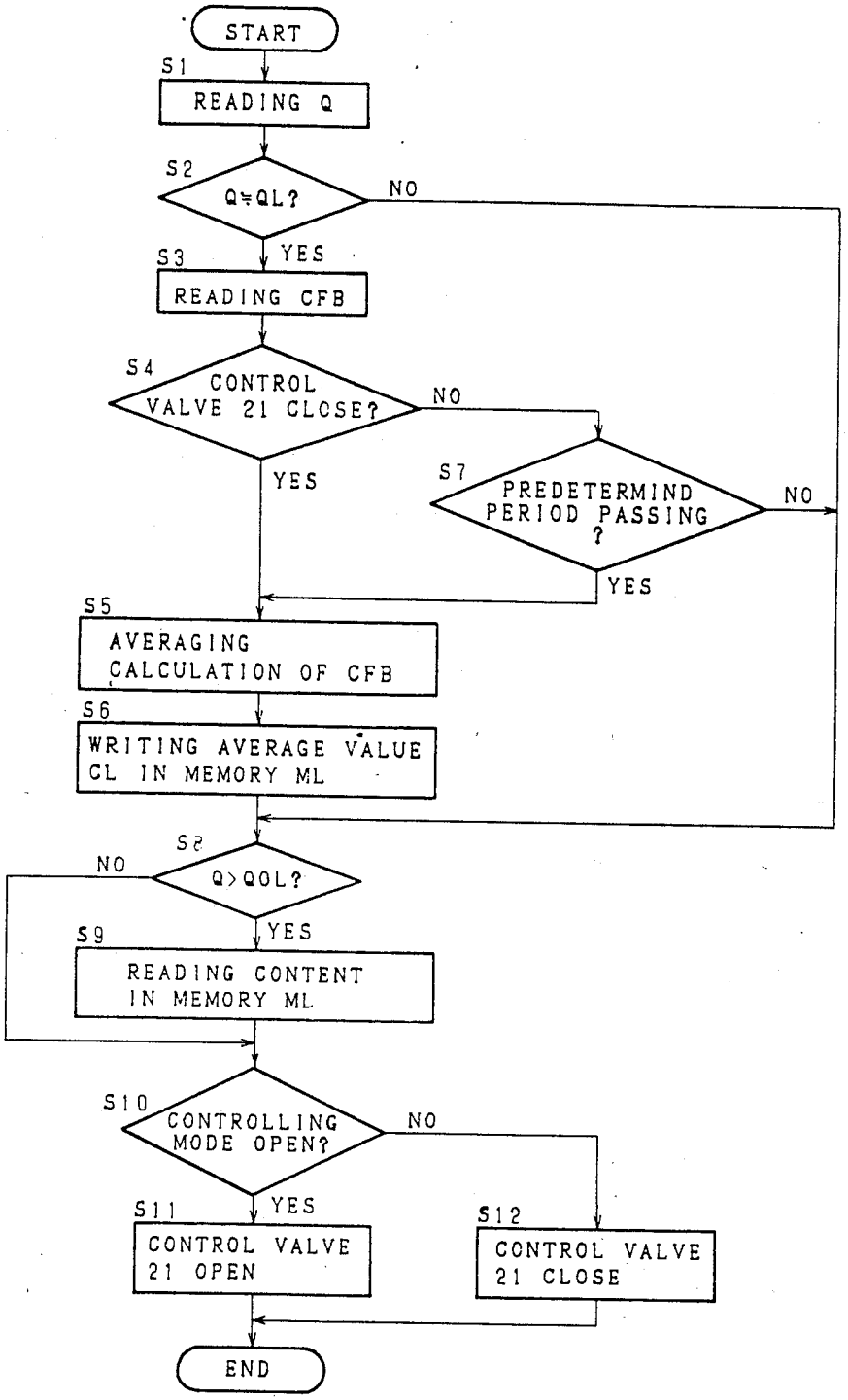
FIG. 3 is the operation flowchart representing an example of execution of programs stored in the ECU of the fuel controller related to the invention.

Next, referring now to the flowchart shown in FIG. 3, the system for executing corrective calculation is described below. FIG. 3 designates the flow of calculations which are repeatedly executed every specific moment for correcting varied characteristic of AFS 2, where designation of fuel control operation and other flows is deleted. In FIG. 3, the CPU 105 reads signal Q outputted from AFS 2 at step S1. When step S2 is entered, the CPU 105 checks to see if the output Q is almost equivalent to the predetermined output from AFS 2, i.e., the representative value QL of flowing volume Q. Note that the representative value QL is selected to be at specific flowing volume that can represent characteristic variation of AFS 2.

Figures 4A, 4B, 4D, 4E:
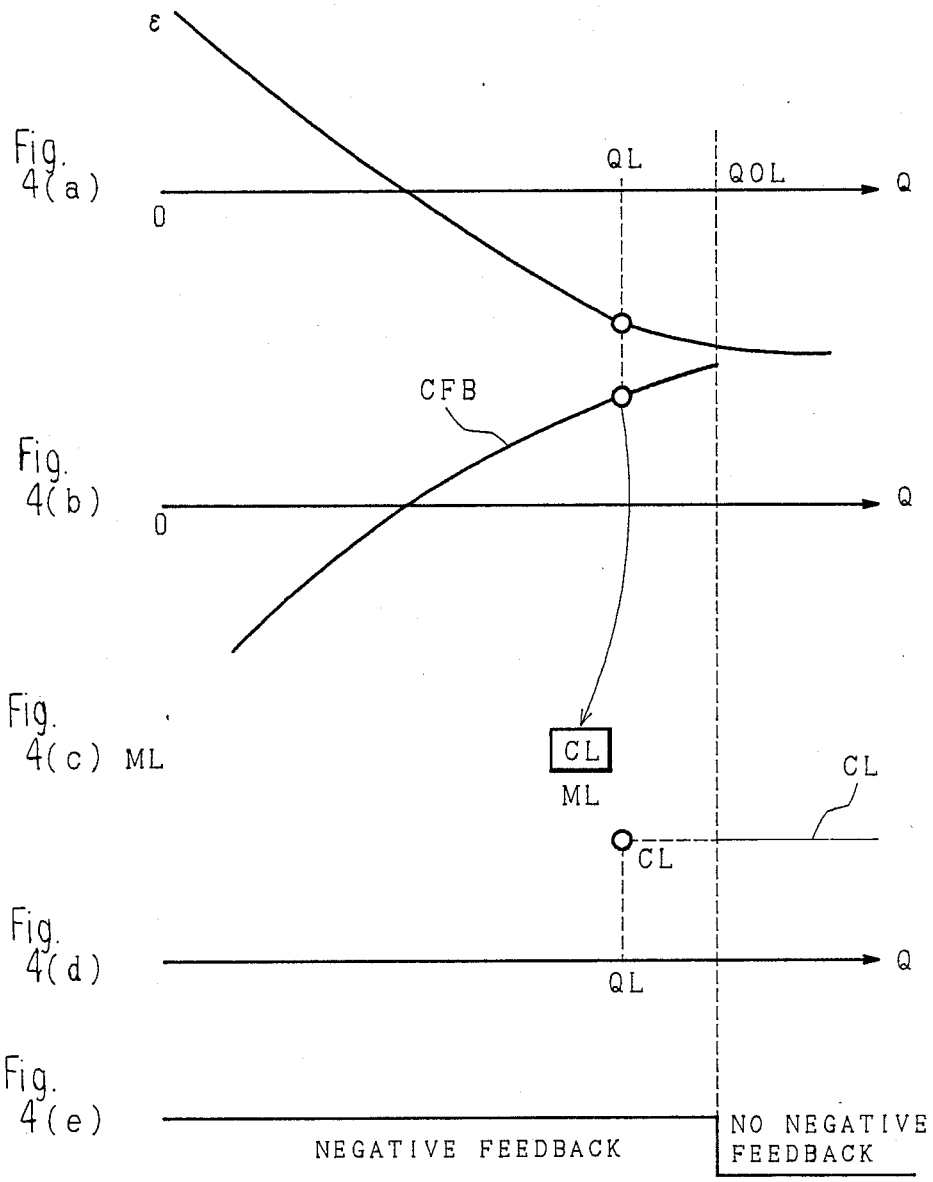
FIGS. 4(*a–e*) are a graphical chart representing variation and correction of physical characteristic of the air-flow sensor of the fuel controller related to the invention.

FIG. 4(*a*) designates characteristic variation $\epsilon$ of AFS 2, where the representative point QL is selected to be at a specific value slightly lower than the flowing volume QOL corresponding to the pressence/absence boundary of negative feedback correction shown in FIG. 4(*e*). When the flowing volume Q is almost equivalent to the representative value QL, operation mode proceeds to step S3, in which the CPU 105 reads the A/F ratio negative feedback volume CFB. The A/F ratio negative feedback volume CFB is the coefficient which corrects the basic volume of injected fuel via negative feedback operation in order that the A/F ratio can be stabilized at the target value by means of $O_2$ sensor 4. The negative feedback volume CFB matches the comparative output processed by proportion and integration after comparison of the output from $O_2$ sensor 4 with the established value. Since this process is conventionally known, detailed description is deleted. However, as shown in FIG. 4(*b*), the A/F negative feedback value CFB cancels characteristic variation $\epsilon$ of AFS 2.

Next, when step S4 is entered, the CPU 105 detects whether gas purging is carried on by the open electric control valve 21 or purging is inhibited by the closed electric control valve 21. When the electric control valve 21 is closed, steps S5 and S6 are activated. While step S5 is underway, the CPU executes averaging calculation of the A/F ratio negative feedback value CFB read in step S3, and then writes the average value CL into memory ML while step S6 is underway. Averaging calculations are executed more than once by adding up and averaging values of varied points (at the maximum and minimum points) of CFB processed by proportion and integration, or by multiplying the past average values by weighted coefficient before final addition of these. Generally, CFB considerably varies itself due to variations on the part of the engine or due to variable factors caused by execution of proportion and integration, and thus, if the momentary value of CFB is written into memory as the correction value, any obstacle may be generated by this value. To prevent this, it is desired that CFB value is averaged. However, if those variations mentioned above are permissible, averaging operation is not always necessary, and instead, the CFB value may be written into memory directly. It is also desirable to provide a non-volatile battery-backup RAM to suffice the needs for memory for storing averaged value CL of CFB.

When the electric control valve 21 is open, operation mode proceeds to step S7. The CPU 105 identifies whether the predetemined period has passed or not after the electric control valve 21 is open. If the predetermined time is past, operation mode proceeds to steps S5 and S6, where the CPU 105 writes the average value (i.e., studied correction value) of CFB into memory ML. Note that step S7 is not always necessary, and thus, if the electric control valve 21 is open, operation mode may proceed to step S8 to inhibit the CPU 105 from writing the studied correction value into memory. In this case, chance for writing the studied correction value into memory diminishes throughout the entire gas-purging period. Step S7 is provided for increasing the chance for writing the studied correction value. In other words, after the predetermined period is past from the start of gas purging, less volume of fuel remains to be purged, and thus, step S7 facilitates the increase of the chance for achieving the studied correction value. When setting the predetermined period, it is convenient to regulate this by providing a certain period needed for decreasing the purgeable fuel to zero. Nevertheless, availing of the dependence of the volume of purgeable fuel on the air volume QP to be delivered to the engine through purging passage, it is more effective to detemine that the predetermined period terminates at the moment when the accumulative value of QP has reached to predetermined value. QP is determined by the internal pressure of surge tank 5 shown in FIG. 1. The internal pressure of surge tank 5 is determined by the flowing volume Q and the number N of the rotation of the engine. In other words, QP can easily be determined by applying expression Q/N.

When step S8 is entered, the CPU 105 checks to see if the flowing volume Q is more than QOL, or not. IF Q is more than QOL, it corresponds to the negative feedback inhibited region. When step S9 is entered, the CPU 105 reads the content of memory ML, i.e., the correction value CL. By correcting the basic volume of fuel to be jetted based on the read-out correction value CL, variable components of characteristic of $O_2$ sensor 4 are removed by a certain amount corresponding to the correction value CL, and as a result, quite satisfactory fuel-control condition is achieved. On the other hand, no correction is applied to the basic volume of injectable fuel against such negative feedback region where Q is less than QOL without using the correction value CL at all. Instead, negative feedback is corrected by means of CFB.

When step S10 is entered, the CPU 105 determines the mode for controlling the electric control valve 21 by applying parameter signal (which is composed of one or the combination of Q/N, N, and the accelerator-aperture detect signal) related to the engine. For example, when idling is underway, the electric control valve 21 is set in the closed mode. When the engine is at any mode other than idling, open mode is applied to the electric control valve 21. When the open mode is set, the electric control valve 21 remains open while step S11 is underway. When the closed mode is set, the electric control valve 21 remains closed while step S12 is underway. The CPU 105 detects the opening/closing condition of the electric control valve 21 in step S4 by referring to the opening/closing control signals from the electric control valve 21.

As is clear from the above description, the flowing volume representative point QL should desirably be set in the region where very large volume of gaseous fuel flows and negative feedback correction is executed. This is because the preferred embodiment of the invention can more precisely correct error in the region where the studied correction value CL is actually applicable. If the correction value CL is applied to the region where the volume of flowing gaseous fuel is less than QL, it does not implement correction, but it aggravates error.

Accordingly, as shown in FIG. 4, it is reasonable to apply the correction value CL to only the region having the flowing volume more than QOL ($\approx$QL). The preferred embodiment regulates the flowing volume having more than QOL and making up the presence-absence boundary of negative feedback correction to specify the region where the correction is executed by applying the studied correction value CL. It is also possible for the preferred embodiment to execute fuel control operation similar to the above by identifying the region having substantial flowing volume in order to stop the negative feedback correction by calculating the number N of the rotation of the engine and the output Q from AFS 2 or Q/N. When the engine driving condition is variable, time corresponding to $Q=QL$ does not last sufficiently, and thus, proper correction value CL cannot be achieved. In practical sense, it is desirable to increase the chance for achieving the correction value CL by estimating that $Q \approx QL$ when Q is in a range from $QL-\Delta Q$ to $QL+\Delta Q$. However, if $\Delta Q$ is too much, due to the dependence of error on the flowing volume, it is obvious that the achieved correction value CL cannot remain constant. There is a certain desirable range in the value of $\Delta Q$.

The above preferred embodiment has referred to the fuel controller using hot-wire air-flow sensor. This is because the hot-wire air-flow sensor shows variable characteristic having significant dependence on the flowing volume by influence of materials deposited on the surface of hot-wire and the effect of slow rotation. Nevertheless, since the vane-type and other air-flow sensors also show variable characteristic having substantial dependence on the flowing volume, the negative feedback correction system of the invention is also very effective.

On the other hand, mode for controlling gas purged from canister 20 is determined by the CPU 105 while step S10 is underway. Electric control valve 21 is closed when a specific drive mode like idling for example is underway. The electric control valve 21 opens itself when any of other drive modes is entered. Purged gas is mixed into air intake air when the electric control valve 21 opens. However, while steps S4 and S7 are undeway, even in the region having the value of $Q \approx QL$ where the study of CFB is executed, renewal of the study is forcibly inhibited during a specific period ranging from the start of opening the electric control valve 21 to the attenuation of purged gas, and as a result, purged gas does not adversely affect the studied correction value CL, and thus, satisfactory study correction is achieved.

As mentioned earlier, the invention provides a memory which stores a specific flow-volume point representing characteristic variation of air-flow sensor or the A/F ratio negative feedback volume at a specific point approximating the flow-volume point. In addition, the preferred embodiment allows fuel-control means to correct the basic volume needed for correcting the fuel flow by utilizing the content of memory. Consequently, the fuel controller embodied by the invention can achieve satisfactory fuel-control condition even when characteristic of the air-flow sensor varies.

Renewal of the study on the negative feedback volume is inhibited for the predetermined period in accordance with the condition of the purge-control valve, and as a result, erroneous A/F ratio caused by purged gas does not adversely affect the correction value stored in memory. Consequently, misguided correction does not occur in the region where substantial volume of gaseous fuel flows, and yet, purged gas does not affect the negative feedback correction value at all.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the metes and bounds of the claims, or equivalence of such meets and bounds thereof are therefore intended to be embraced by the claims.

What is claimed is:

1. A fuel controller comprising:

a means for supplying fuel to an internal combustion engine in accordance with operation of a fuel control valve;

an air-flow sensor, being disposed in an air intake passage of said engine, for detecting a volume of air intake;

an air-fuel ratio sensor, being installed to an exhaust tube of said engine, for detecting an air-fuel ratio; and a controlling means, for computing a basic value of volume of fuel needed for said engine in accordance with a signal outputted from said air-flow sensor, controlling the operation of said control valve in response to the computed basic value, and executing negative feedback correction of said basic value in accordance with a signal outputted from said air-fuel ratio sensor so that air-fuel ratio can achieve a desired value, said controlling means having a memory for storing volume of negative feedback correction executed when said signal outputted from said air-flow sensor approximates a predetermined value, and a means for correcting said basic value in accordance with a content stored in said memory, said predetermined value being a value slightly less than an air-flow volume at a presence-absence boundary of said negative feedback correction.

2. The fuel controller as set forth in claim 1, wherein said air-flow sensor is a hot-wire air-flow sensor.

3. The fuel controller as set forth in claim 1, wherein said volume related to said negative feedback correction is a volume computed by averaging the volume of negative feedback correction executed for plural times.

4. The fuel controller as set forth in claim 1, wherein said memory is a non-volatile memory composed of a battery-backup RAM.

5. The fuel controller as set forth in claim 1, wherein further comprising;

a canister for catching evaporated gaseous fuel delivered from a fuel tank; and a purge-control valve for controlling the volume of said gaseous fuel purged into said air intake passage.

6. A fuel controller comprising:

a meansfor supplying fuel to an internal combustion engine in accordance with operation of a fuel control valve;

an air-flow sensor, being disposed in an air intake passage of said engine, for detecting a volume of air intake;

an air-fuel ratio sensor, being installed to an exhaust tube of said engine, for detecting an air-fuel ratio; and a controlling means, for computing a basic value of volume of fuel needed for said engine in accordance with a signal outputted from said air-flow sensor, controlling the operation of said control valve in response to the computed basic value, and executing negative feedback correction of said basic value in accordance with a signal outputted from said air-fuel ratio sensor so that said air-fuel ratio can achieve a desired value;

a canister for catching evaporated gaseous fuel delivered from a fuel tank; and a purge-control valve for controlling the volume of said gaseous fuel purged into said air intake passage, said controlling means having a memory for storing volume of negative feedback correction executed when said signal outputted from said air-flow sensor approximates a predetermined value, a means for correcting said basic value in accordance with a content stored in said memory, a means for controlling an opening/closing operation of said purge control valve in accordance with a driving condition of said engine, and an inhibiting means for determining the period of inhibiting data from being written into said memory in accordance with an opening/closing condition of said purge-control valve and inhibiting said data from being written into said during said period, said inhibiting means inhibiting data from being written into said memory until a predetermined time passes from the moment at which said purge-control valve opens.

7. A fuel controller comprising:

a means for supplying fuel to an internal combustion engine in accordance with operation of a fuel control valve;

an air-flow sensor, being disposed in air intake passage of said engine, for detecting a volume of air intake;

an air-fuel ratio sensor, being installed to an exhaust tube of said engine, for detecting an air-fuel ratio; and a controlling means, for computing a basic value of volume of fuel needed for said engine in accordance with a signal outputted from said air-flow sensor, controlling the operation of said control valve in response to the computed basic value, and executing negative feedback correction of said basic value in accordance with a signal outputted from said air-fuel ratio sensor so that air-fuel ratio can achieve a desired value;

a canister for catching evaporated gaseous fuel delivered from a fuel tank; and a purge-control valve for controlling the volume of said gaseous fuel purged into said air intake passage, said controlling means having a memory for storing a volume of negative feedback correction executed when said signal outputted from said air-flow sensor approximates a predetermined value, a means for correcting said basic value in accordance with a content stored in said memory, means for controlling an opening/closing operation of said purge-control valve in accordance with a driving condition of said engine, and an inhibiting means for determining the period of inhibiting data from being written into said memory in accordance with an opening/closing condition of said purge-control valve and inhibiting said data from being written into said memory during said period, said inhibiting means inhibiting data from being written into said memory until an accumulative volume of said gaseous fuel purged into said air intake passage reaches a predetermined value.

* * * * *